United States Patent [19]

Kwok

[11] Patent Number: 5,023,131

[45] Date of Patent: Jun. 11, 1991

[54] COTTON/POLYESTER FIBER BLENDS AND BATTS

[75] Inventor: Wo K. Kwok, Hockessin, Del.

[73] Assignee: E. I. du Pont de Nemours and Company, Wilmington, Del.

[21] Appl. No.: 526,721

[22] Filed: May 22, 1990

Related U.S. Application Data

[63] Continuation-in-part of Ser. No. 361,418, Jun. 5, 1989, abandoned.

[51] Int. Cl.[5] ..... D04H 1/58

[52] U.S. Cl. ..... 428/288; 156/296; 156/308.4; 264/123; 264/126; 428/198; 428/296; 428/297; 428/360

[58] Field of Search ..... 428/288, 297, 198, 296, 428/360; 156/296, 308.4; 264/123, 126

[56] References Cited

U.S. PATENT DOCUMENTS

| | | | |
|---|---|---|---|
| 4,685,914 | 8/1987 | Holtman | 604/368 |
| 4,769,022 | 9/1988 | Chang et al. | 604/368 |

FOREIGN PATENT DOCUMENTS

| | | |
|---|---|---|
| 227914 | 10/1986 | European Pat. Off. . |
| 60-029182A | 2/1985 | Japan . |
| 60-040239A | 3/1985 | Japan . |

OTHER PUBLICATIONS

Polyester Staple for Thermally Bonded Nonwovens by W. K. Kwok et al., Nonwovens Industry, Jun. 1988.

*Primary Examiner*—James J. Bell

[57] ABSTRACT

A blend, a batt, and a process for making the batt from the blend is disclosed. The blend and batt are made from a uniform combination of cotton and copolyester binder fibers wherein the binder fibers have a melting temperature of 230° to 340° F.

10 Claims, No Drawings

COTTON/POLYESTER FIBER BLENDS AND BATTS

CROSS REFERENCE TO RELATED APPLICATIONS

This application is a continuation-in-part of my copending application, Ser. No. 07/361,418, filed June 5, 1989 now abandoned.

BACKGROUND OF THE INVENTION

1. Field of the Invention

This invention relates to blends of cotton and polyester copolymer binder fibers and to batts made from such blends. The batts are made by means of a thermal bonding process; and they are durable enough to withstand the stresses of repeated washings. The blends are of a high bulk and a low density.

2. Description of the Prior Art

U.S. Pat. No. 4,685,914, issued Aug. 11, 1987 (Personal Products) teaches the manufacture of an absorbent pad by heat fusing a combination of absorbent fibers and binder fibers. Absorbent fibers can be wood pulp, rayon, cellulose acetate, flax, hemp, jute, ramie, cotton, and the like. Binder fibers are polyester. One pad, using a blend of polyester staple and polyester binder fibers and a blend of acrylic fibers and polyester binder fibers, is about 20–25% binder fibers and is bonded at about 315° F.

European Patent publication 227,914 seems to teach consolidation of cotton swabbing by superficially fusing thermoplastic fibers uniformly distributed throughout the cotton. The temperature for the fusing appears to be about 250° F.

Japanese Publications, J60029182A (Toray) and J60040239A (Kanegafuchi), available in abstract form, teach manufacturing a blend of fibers; and fusing the blend by thermal means. The fibers can be selected from a list of relatively high melting materials including polyester, polypropylene, polyacrylic, cotton, wool, hemp, rayon, and the like; and a list of binder fibers including copolyester, polyolefin, and the like.

U.S. Pat. No. 4,769,022, issued Sept. 6, 1988 (3M) teaches the preparation of a pad made by heating a blend of 50/50, wt. cotton and polyester for 20 seconds at 285° F.

*Polyester Staple for Thermally Bonded Nonwovens*, by W. K. Kwok, et al., Nonwovens Industry, June, 1988, teaches that particular polyester binder fiber products can be used to make thermally bondable blends of fibers. Cotton is not mentioned as a candidate fiber for the blends.

SUMMARY OF THE INVENTION

The present invention provides a thermofusible blend of fibers including a uniform mixture of 75–85 weight percent cotton and 15–25 weight percent ethylene terephthalate/isophthalate copolyester comprising 60–80 mole percent terephthalate and 20–40 mole percent isophthalate and having a melting point of about 230° to 340° F.

The invention includes a process for fusing the aforementioned blend by subjecting the blend to heat at a temperature of about 230° to 390° F. for a duration of from 20 to 100 seconds under no compressive pressure. The invention, also, includes a batt which results from the aforementioned process, has a density of 0.014 to 0.038 grams per cubic centimeter, and is capable of withstanding repeated washing stresses.

DETAILED DESCRIPTION OF THE INVENTION

This invention is directed toward the use of cotton fibers in a blend of other fibers including copolyester binder fibers. Despite the fact that the blend contains cotton fibers which are not thermofusible, it also includes thermofusible binder fibers and can, therefore, be heated and melted to create bonds between adjacent fibers. The invention represents a means for utilizing cotton staple to make improved batts of high quality, low density, and excellent durability.

Cotton staple can be obtained from any commercial source and it can be scoured or not and bleached or raw. For the purposes of this invention, cotton can also mean wood pulp and regenerated cellulose such as rayon.

The copolyester preferred for use in the practice of this invention is a copolyester made from a mole-for-mole condensation of ethylene glycol and a combination of terephthalic and isophthalic acids. For such a copolyester having a terephthalate/isophthalate mole ratio of 70/30, it has a melting point of about 288° F. and a stick point of about 194° F. Fibers made from this copolyester serve as thermal binder fibers and must exhibit melting points below the temperature at which cotton is discolored and must, also, exhibit a melt adhesion to cotton staple.

Fibers used in this invention are used in a blend form and the fibers in the blend must be chosen to interact appropriately at the time that the blend is transformed into a durable batt. One of the important elements of interaction resides in the relative sizes of the cotton fibers and the binder fibers. The cotton fibers should have a denier of 1.0 to 1.8 and preferably about 1.6; and it has been found that lengths of from 0.8 to 1.5 inches are preferred. The binder fibers should have a denier about the same as the cotton staple; but, if they must be somewhat different, they should be from 0.75 to 2.7 times the denier of the cotton. The length of the binder fibers can range from 0.5 to 3 inches; but it is preferred that the binder fibers be from 0.75 to 2.0 times the length of the cotton staple in any given blend.

The cotton fibers and the copolyester fibers can be combined by any commercial blending equipment. Of course, the combination of fibers can be accomplished by any other effective means; provided, only, that the blend is a uniform mixture of the different fibers.

It should be pointed out that the blends of this invention are not limited to cotton and copolyester fibers, alone. If it is desired or required for any reason, other fibers can be added to the blend and the other fibers can perform an active function or can merely be present as a filler material. The other fibers can be hollow or solid and inorganic or organic, whether natural or synthetic. Additive materials other than fibers can, also, be added to the blends as fillers, colorants, scents, antimicrobial agents, bulking agents, flame retardants, antistats, and the like. In the case of additive materials, it has been found that they should, generally, be used in an amount of from 0.1 to 20 weight percent, based on the total weight of the blend. In the case of additive fibers which perform an active function in the blends, the amount of fibers should be chosen to accomplish the desired purpose.

The blends of this invention include 15 to 25 weight percent copolyester binder fibers based on the total amount of fiber in the blends. It has been determined that blends made from less than 15 percent of copolyester binder fibers cannot be bonded for adequate durability at any conditions; and that blends made from more than 25 percent of copolyester binder fibers result in bonded batts which exhibit poor wash durability. Blends having 15 to 25 percent copolyester binder fibers yield batts of very good and durable qualities. As has been disclosed in the art, binder material need only be present as a surface component of the binder fiber, for example as a sheath component of a sheath/core bicomponent fiber. The remainder or core of the fiber may be of higher melting point, and thus would remain in fiber form as a bridging structure after the lower melting material has fused and performed its binding function. Such bicomponent binder fibers have been disclosed, for example, in U.S. Pat. Nos. 3,589,956 and 4,068,036. It will be understood that, for best results when using bicomponent fibers, some corresponding adjustment of proportions may be advisable to optimize results in relation to those preferred when monocomponent binder fibers are blended with cotton.

Blends can be made into batts of this invention as a single layer of the blend or it can be built up of several layers. Typically, the batt will be formed from several layers of a card-formed or garnett-formed web of the blend, by crosslapping the web on a moving apron to the batt thickness desired such as disclosed in U.S. Pat. No. 3,290,704. Once formed, the batt is subjected to heat at a temperature equal to or greater than the stick temperature of the binder fibers such that the binder fibers will be softened and will adhere to themselves and to the cotton fibers in the batt. The heat can be provided by means of open ovens, through-air drums or ovens, infrared heaters, radiation heaters, and the like. The heat should not exceed the temperature at which cotton begins to discolor, that is, about 390° F., and preferably somewhat less. The temperature of the heat should be as low as possible; and, for that reason, it is important that a copolyester is used with a low melting point. In practical operation, bonding temperatures of 360° to 380° F. are high. Duration of the heating should be adequate for the binder fiber to soften and ahdere—usually from 20 to 100 seconds or, perhaps, slightly longer. Because it is the intention to make batts having as low a density as possible, the heating is, generally, conducted with no pressure on the batts. However, the batts can be heated under some degree of compressive strength to achieve whatever batt density is desired for any particular purpose.

The batts of this invention are useful for fiberfill, insulation, padding, resilient cushioning, and the like. The batts are generally made to have a density of 0.018 to 0.038 grams per cubic centimeter. These batts exhibit excellent washability and have high strength as indicated by large values of adjusted total work-to-break. Washability is a measure of the durability of batts of this invention through automatic washing and drying cycles. It has been found that batts with two little binder fiber disintegrate during laundering because of inadequate fiber-to-fiber adhesion and that batts with too much binder fiber are boardy and are broken apart during laundering because of being too stiff and brittle. Batts of this invention exhibit an appearance after laundering which is superior to batts made using the same kinds of materials under the same conditions but with less than 15 or more than 25 weight percent copolyester binder fibers. Test methods used to determine these qualities are set out below.

Test Methods

Denier - The denier of a filament is calculated from its fundamental resonant frequency, determined by vibrating a 2 to 4 cm length of filament under tension with changing frequency. (ASTM D1577-66), part 25, 1968).

Density - The density of a batt is determined by weighing a batt of known volume.

Stick Temperature - Fiber stick temperature is measured as described by Beaman and Cramer, J. Polymer Science 21, page 228 (1956). A flat brass block is heated electrically to raise the block temperature at a slow rate. The fiber sample is suspended under slight tension between glass rods over and near the surface of the block. At intervals, the fiber is pressed against the block for 5 seconds with a 200 gram brass weight which has been in continuous contact with the heated block. The fiber stick temperature is the temperature of the block when the fiber sticks to it for at least 2 seconds after removing the weight.

Work-to-Break - The strength of the batts of this invention is measured by determining the Adjusted Total Work to Break. The Adjusted Total Work to Break is determined to accordance with ASTM D885 - 85 as follows:

Samples of the batt to be tested are cut 1 inch wide and 7 inches long. Ten of those samples are cut with the length in the machine direction and ten are cut with the length in the transverse direction. The samples are conditioned for 2 hours at about 75° and 55% relative humidity.

Each of the samples is mounted in the jaws of a tensile testing machine with a 5 inch gage length; and the samples are pulled with the results recorded on a stress-strain curve generated by the testing machine.

The Work-to-Break is calculated using the equation $$\textit{Work-to-Break, in.-lbf.} = A \times F \times E$$

wherein

A = area under the load-elongation curve, in.$^2$,

F = load scale factor, in., of chart, and

E = elongation scale factor, in., of specimen elongation per inch of chart.

Work-to-Break is the average value of ten samples. Work-to-Break is determined for the machine direction and for the transverse direction. Total Work-to-Break is the sum of the machine direction Work-to-Break and the transverse direction Work-to-Break.

To calculate the Adjusted Total Work-to-Break, the Total Work-to-Break is divided by the basis weight of the batt in ounces per yard$^2$. For purposes of this invention, acceptable batts exhibit an Adjusted Total Work-to-Break of greater than 2 inch-pounds per oz/yd$^2$.

Appearance after Laundering - A quality of major importance for the batts of this invention is the durability of the batts to laundering stresses. The test for such durability is the AATCC Test Method 135-1987 (AATCC stand for American Association of Textile Chemists and Colorists). In the conduct of this test, 3 test batts 8×8 inches are used for each batt to be tested. The laundering is conducted in automatic washing and drying machines in accordance with the AATCC procedure wherein the normal or cotton settings are used for the washer, cotton settings are used for the dryer, and a 4.0 pound load is used. To complete the test, a total of five cycles of washing and drying are used.

The samples are judged by their appearance on a scale of 1 to 4, with 1 being worst—having fibers lumping together and exhibiting nonuniformity—and 4 being best—having excellent appearance with uniformity similar to the unwashed original sample. A batt appearance of 2.5 is considered acceptable for purposes of this invention.

DESCRIPTION OF THE PREFERRED EMBODIMENTS

EXAMPLE 1

Preparation of the Blends - In this example, blends of fibers were made in accordance with the present invention.

Cotton staple was used which was scoured and bleached and which had a denier of about 1.0 and an average length of about 1.1 inch (a range of 0.8 to 1.5 inches).

Copolyester binder fibers were used which had ethylene and a 70/30 mole ratio of terephthalate and isophthalate groups, a stick point of 194° F., and a melting point of 288° F. The binder fibers had a denier of about 3 and an average length of about 1.5 inches.

Cotton fibers and copolyester fibers were combined and blended in a commercial opener-blender such that the blend was uniform and such that there were varying concentrations of binder fibers in each of several runs.

The several runs are identified in the Tables which follow the Examples.

EXAMPLE 2

Preparation of the Batts - In this example, blends from Example 1 were thermally bonded to yield batts of the present invention.

Blends from Example 1 were carded on a 40 inch roller top carding machine to yield a continuous web which was crosslapped to a continuous batt having a basis weight of 3 to 8 ounces per square yard.

The batts were placed on a conveyer and passed through a through-air oven of 2 meters length at various speeds and various temperatures. The temperatures and rates for the thermal bonding were 230° to 420° F. and 1.3 to 5 meters/minute.

The batts were tested for the Adjusted Total Work-to-Break and the Batt Appearance. Results of the tests are set out in Table I below.

TABLE I

| Run No. | BOND TEMP (F.) | BOND RATE (m/min) | BASIS WT. (oz/yd$^2$) | ADJUSTED TOTAL WORK cross | mach. | = total | BATTING APPEAR |
|---|---|---|---|---|---|---|---|
| | | | Binder 10% | | | | |
| 1 | 300 | 1.29 | 4.5 | 0.624 | 0.710 | 1.334 | |
| 2 | 310 | 1.29 | 4.2 | 1.016 | 0.875 | 1.892 | |
| 3 | 320 | 1.29 | 4.2 | 1.062 | 0.914 | 1.977 | 2.3 |
| 4 | 330 | 1.29 | 4.1 | 1.211 | 1.158 | 2.369 | |
| 5 | 340 | 1 29 | 4.1 | 1.371 | 1.163 | 2.534 | |
| 6 | 350 | 1.29 | 4.3 | 1.057 | 1.083 | 2.139 | 2.2 |
| 7 | 360 | 1.29 | 3.9 | 1.227 | 1.427 | 2.653 | |
| 8 | 370 | 1.29 | 4.0 | 1.459 | 1.760 | 3.218 | |
| 9 | 370 | 2.26 | 4.1 | 1.171 | 1.070 | 2.242 | |
| 10 | 370 | 5.00 | 5.3 | 0.505 | 0.515 | 1.020 | |
| 11 | 380 | 1.29 | 4.6 | 1.509 | 1.553 | 3.061 | 2.3 |
| 12 | 390 | 1.29 | 4.1 | 1.988 | 1.388 | 3.376 | |
| 13 | 400* | 1.29 | 4.0 | 1.470 | 1.639 | 3.110 | |
| 14 | 410* | 1.29 | 4.8 | 1.494 | 1.824 | 3.317 | 2.3 |
| 15 | 420* | 1.29 | 4.6 | 1.730 | 1.853 | 3.583 | |
| 16 | 420* | 2.26 | 4.4 | 1.588 | 1.567 | 3.156 | 2.2 |
| 17 | 420* | 3.10 | 4.0 | 1.743 | 1.946 | 3.688 | 2.5 |
| 18 | 420* | 5.00 | 4.6 | 0.809 | 0.809 | 1.618 | 2.7 |
| | | | Binder 20% | | | | |
| 19 | 280 | 1.29 | 3.9 | 1.249 | 1.454 | 2.703 | |
| 20 | 290 | 1.29 | 5.0 | 1.085 | 0.963 | 2.048 | 2.8 |
| 21 | 300 | 1.29 | 4.8 | 1.435 | 1.160 | 2.595 | |
| 22 | 310 | 1.29 | 4.4 | 1.611 | 1.507 | 3.118 | |
| 23 | 320 | 1.29 | 5.2 | 1.281 | 1.278 | 2.559 | 3.5 |
| 24 | 330 | 1.29 | 5.0 | 1.745 | 1.431 | 3.176 | |
| 25 | 340 | 1.29 | 4.7 | 1.736 | 1.890 | 3.626 | |
| 26 | 350 | 1.29 | 4.5 | 1.893 | 2.304 | 4.197 | 2.2 |
| 27 | 360 | 1.29 | 4.0 | 2.352 | 2.266 | 4.619 | |
| 28 | 370 | 1.29 | 4.7 | 2.206 | 2.471 | 4.678 | |
| 29 | 380 | 1.29 | 4.5 | 2.408 | 2.383 | 4.791 | 3.5 |
| 30 | 390 | 1.29 | 4.2 | 2.806 | 2.466 | 5.273 | |
| 31 | 400* | 1.13 | 4.3 | 2.353 | 2.146 | 4.499 | |
| 32 | 410* | 1.29 | 4.1 | 3.281 | 2.935 | 6.216 | 3.5 |
| 33 | 420* | 1.29 | 4.5 | 3.063 | 3.193 | 6.256 | |
| 34 | 420* | 2.26 | 4.9 | 2.372 | 2.485 | 4.857 | 3.0 |
| 35 | 420* | 3.10 | 5.2 | 2.032 | 1.964 | 3.996 | 2.8 |
| 36 | 420* | 5.00 | 4.4 | 1.789 | 1.514 | 3.302 | 3.2 |
| | | | Binder 30% | | | | |
| 37 | 230 | 1.29 | 7.6 | 0.892 | 0.772 | 1.665 | 1.3 |
| 38 | 237 | 1.29 | 5.1 | 0.992 | 0.945 | 1.938 | |
| 39 | 240 | 1.29 | 4.6 | 1.037 | 1.085 | 2.122 | |
| 40 | 240 | 1.29 | 7.3 | 1.145 | 1.015 | 2.161 | |
| 41 | 250 | 1.29 | 4.3 | 1.044 | 1.005 | 2.049 | |
| 42 | 260 | 1.29 | 4.2 | 0.769 | 1.277 | 2.047 | 3.2 |
| 43 | 270 | 1.29 | 4.3 | 1.219 | 1.294 | 2.513 | |
| 44 | 280 | 1.29 | 3.8 | 1.646 | 1.608 | 3.254 | |

TABLE I-continued

| Run No. | BOND TEMP (F.) | BOND RATE (m/min) | BASIS WT. (oz/yd$^2$) | ADJUSTED TOTAL WORK cross + mach. = total | | | BATTING APPEAR |
|---|---|---|---|---|---|---|---|
| 45 | 290 | 1.29 | 3.9 | 1.333 | 1.517 | 2.849 | 2.0 |
| 46 | 300 | 1.29 | 5.5 | 1.408 | 1.481 | 2.889 | |
| 47 | 310 | 1.29 | 5.3 | 1.636 | 1.461 | 3.097 | |
| 48 | 320 | 1.29 | 5.5 | 1.372 | 0.849 | 2.221 | 2.3 |
| 49 | 330 | 1.29 | 5.6 | 1.481 | 0.886 | 2.368 | |
| 50 | 340 | 1.29 | 5.5 | 1.706 | 1.154 | 2.860 | |
| 51 | 350 | 1.29 | 5.3 | 2.031 | 1.601 | 3.632 | 2.3 |
| 52 | 360 | 1.29 | 5.1 | 1.963 | 1.564 | 3.527 | |
| 53 | 370 | 1.29 | 5.4 | 2.650 | 2.092 | 4.742 | |
| 54 | 380 | 1.29 | 5.2 | 2.294 | 2.410 | 4.704 | 3 |
| 55 | 390 | 1.29 | 4.7 | 3.215 | 2.810 | 6.025 | |
| 56 | 400* | 1.29 | 4.9 | 2.910 | 2.888 | 5.797 | |
| 57 | 410* | 1.29 | 4.9 | 6.620 | 5.012 | 11.632 | |
| 58 | 420* | 1.29 | 5.2 | 2.879 | 2.957 | 5.836 | 2.8 |
| 59 | 420* | 2.26 | 6.4 | 2.298 | 1.656 | 3.954 | 3.2 |
| 60 | 420* | 5.00 | 5.2 | 1.616 | 1.477 | 3.093 | 2.8 |

*Indicates that the temperature is too high - the cotton discolors during processing.

I claim:

1. A thermofusible blend of fibers including a uniform mixture of from 75 to 85 weight percent cotton and 15 to 25 weight percent copolyester binder fibers having a melting point of from 230° to 340° F.

2. The blend of claim 1 wherein the cotton fibers are from 1 to 1.8 denier and 0.8 to 1.5 inches in length and the binder fibers are 0.5 to 2.7 times the denier of the cotton and 0.75 to 2.0 times the length of the cotton and are of an ethylene terephthalate/isophthalate copolyester with a mole ratio of terephthalate to isophthalate from 80/20 to 60/40.

3. The blend of claim 2 wherein the copolyester has a mole ratio of terephthalate to isophthalate of 70/30.

4. A process for making a durable batt from a blend of fibers wherein a uniform mixture of from 75 to 85 weight percent cotton and 15 to 25 weight percent copolyester binder fibers having a melting point of from 230° to 340° F. comprising the steps of forming the blend into a batt and heating the batt at a temperature of 230° to 390° F. for 20 to 100 seconds to effect softening of the binder fibers and bonding of the fibers at points of intersection.

5. The process of claim 4 wherein the binder fiber is an ethylene terephthalate/isophthalate copolyester with a mole ratio of terephthalate to isophthalate from 80/20 to 60/40.

6. The process of claim 5 wherein the copolyester has a mole ratio of terephthalate to isophthalate of 70/30.

7. A batt of a uniform mixture of from 75 to 85 weight percent cotton and 15 to 25 weight percent copolyester binder fibers having a melting point of from 230° to 340° F. wherein the binder fibers are bonded randomly at points of intersection with other fibers in the batt and wherein the adjusted total work-to-break is greater than 2.0 pound-inches per oz/yd$^2$ and the density is less than 0.038 grams per cubic centimeter.

8. The batt of claim 7 wherein the binder fiber is an ethylene terephthalate/isophthalate copolyester with a mole ratio of terephthalate to isophthalate from 80/20 to 60/40.

9. The batt of claim 8 wherein the copolyester has a mole ratio of terephthalate to isophthalate of 70/30.

10. The batt of claim 7 wherein the batt exhibits an appearance after laundering which is superior to batts made using the same kinds of materials under the same conditions but with less than 15 or more than 25 weight percent copolyester binder fibers.

* * * * *

UNITED STATES PATENT AND TRADEMARK OFFICE

CERTIFICATE OF CORRECTION

PATENT NO. : 5,023,131

DATED : June 11, 1991

INVENTOR(S) : Wo K. Kwok

It is certified that error appears in the above—identified patent and that said Letters Patent is hereby corrected as shown below:

Column 7, line 28 should read:
the binder fibers are 0.75 to 2.7 times the denier of the Signed and Sealed this Twenty-sixth Day of October, 1993

*Attest:*

Bruce Lehman

BRUCE LEHMAN

*Attesting Officer*

*Commissioner of Patents and Trademarks*